United States Patent [19]

Pfäffle

[11] 4,286,908

[45] Sep. 1, 1981

[54] DEVICE FOR FACILITATING SEPARATION OF SHEET GROUPS

[75] Inventor: Ernst Pfäffle, Neuffen, Fed. Rep. of Germany

[73] Assignee: Hans Sickinger Company, Pontiac, Mich.

[21] Appl. No.: 968,272

[22] Filed: Dec. 11, 1978

[51] Int. Cl.[3] ..... B65G 59/06

[52] U.S. Cl. ..... 414/115; 221/279; 271/160; 271/165; 414/907

[58] Field of Search ..... 414/114, 125, 128, 129, 414/907, 115; 83/281, 417; 271/160, 165, 166, 220; 100/265; 93/93 R; 221/151, 152, 279

[56] References Cited

U.S. PATENT DOCUMENTS

| | | | |
|---|---|---|---|
| 3,231,100 | 1/1966 | Faeber | 414/45 X |
| 3,452,628 | 7/1969 | Pfäffle | 83/167 |
| 4,197,045 | 4/1980 | Stauber | 414/907 X |

*Primary Examiner*—Leslie J. Paperner
*Attorney, Agent, or Firm*—Harness, Dickey & Pierce

[57] ABSTRACT

A device for use in conjunction with a sheet group separator of the type having a rotating slotted disk supporting a stack, together with a depressor for the lowermost group, and a finger for separating a corner of said group from the stack. The device comprises a vertically slidable weight at said stack corner so that a constant downward pressure is exerted to prevent upward curling of the corner which might reduce the effectiveness of the finger and depressor movements. A counterweighted pressure bar is pivotally mounted at the lower end of the weight so that placing additional sheets on the stack will not interfere with the operation. The weight is reset by pulling upwardly on a handle so that the pressure bar swings away to clear the new sheets and is swung back into position by the counterweight.

1 Claim, 6 Drawing Figures

DEVICE FOR FACILITATING SEPARATION OF SHEET GROUPS

BACKGROUND OF THE INVENTION

1. Field of the Invention

The invention relates to the separation of sheet groups from the bottom of a stack; for example, in advance of a punching station for forming perforations in the edges of booklet sheets for the reception of wire hinges.

2. Description of the Prior Art

My U.S. Pat. No. 3,452,628 issued July 1, 1969, shows a hole punching machine for paper sheets which incorporates a sheet group separating mechanism of the type with which the present invention is concerned. This mechanism utilizes one or more rotating slotted disks on which the sheet stack rests. A finger adjacent the lower portion of the stack at one corner enters to separate a group of sheets, and a depressor depresses the corner so that it will pass into a disk slot. Continued rotation of the disk results in a group of sheets passing beneath the disks to a conveyor.

A problem arises on occasion with respect to such equipment if ambient conditions are such that the paper edges tend to curl, pull up and contract. In this case, the finger and/or the depressor may only partially engage or entirely miss the proper position on the stack so that only a portion of the sheet group, or none at all, will drop down below the disks.

BRIEF SUMMARY OF THE INVENTION

It is an object of the invention to provide a novel and improved device for facilitating the separation of sheet groups from the bottom of a stack which will overcome the above-described problem and insure proper engagement of the stack by the finger and depressor regardless of ambient conditions, thus increasing the effectiveness of the separating mechanism.

It is another object to provide an improved device of this character which is simple and economical to construct and reliable in use.

Briefly, the device comprises, in combination, guide means for retaining a stack of sheets, a rotating slotted disk supporting said sheets, a finger and depressor at one corner of said sheets for periodically separating a sheet group at the bottom of the stack for entry into a disk slot, means for maintaining constant downward pressure on said corner of the stack comprising a vertically slidable weight mounted at said corner, a pressure bar movably mounted at the lower end of said weight and engageable with the top of said stack, and means for lifting said weight upwardly, said pressure bar being so shaped as to retract into non-interfering relation with sheets above it when said weight is lifted and move into stack-engaging position after said pressure bar has been lifted above the top of the stack.

DESCRIPTION OF THE PREFERRED EMBODIMENT

Figure 1:
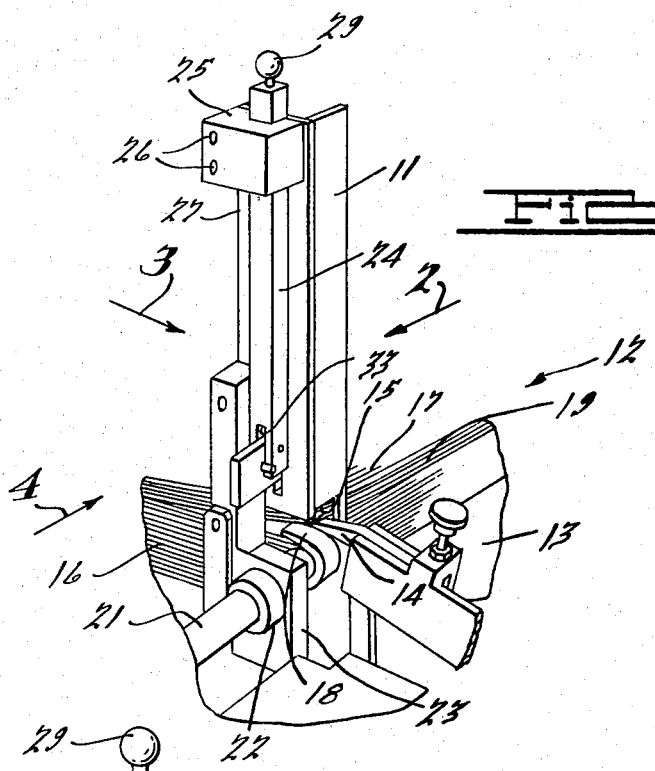
FIG. 1 is a perspective view showing the device used in conjunction with a stacking guide.

FIG. 1 shows a corner stacking guide 11 comprising a vertical angle-shaped member which retains the corner of a stack of sheets generally indicated at 12. These sheets are supported by a disk partially shown at 13 which is slotted and rotates beneath the stack. A finger 14 is provided which periodically is inserted through a slot 15 in the lower portion of guide 11 and enters the stack to separate the sheet group 16 at the bottom of the stack from the remainder 17 of the stack. Finger 14 lifts stack portion 17 so that a depressor 18 may enter the gap 19 between portions 16 and 17 of the stack. Depressor 18 is mounted on a rotating shaft 21 supported by a bearing 22 in a bracket 23. This mechanism is all shown and described in greater detail in the above-identified U.S. Pat. No. 3,452,628. When depressor 18 enters gap 19, its rotation will depress sheet group 16 so that this sheet group may enter a slot in the rotating disk 13. The sheet group will then drop below the disk and onto a conveyor.

A problem occasionally arises because the ambient temperature and humidity conditions, especially in winter, may cause the edges of the sheets to contract and to curl up. This might prevent proper engagement by either or both of finger 14 and depressor 18.

Figure 2:
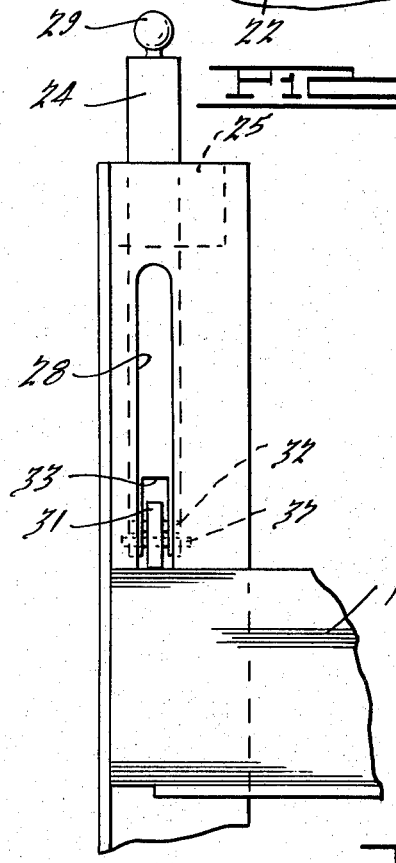
FIG. 2 is a front elevational view of the device taken in the direction of the arrow 2 of FIG. 1.

The device of the present invention comprises a weight 24 in the form of a bar having a rectangular cross-sectional shape. This bar is mounted in a guide 25 secured by fasteners 26 to the upper portion of guide 11. Weight 24 is mounted on the outside of flange 27 of guide 11, this flange having a slot 28 as shown in FIG. 2. A knob 29 surmounts weight 24 for elevating the bar above stack portion 17 or any additional sheets which are placed thereabove.

Figure 6:
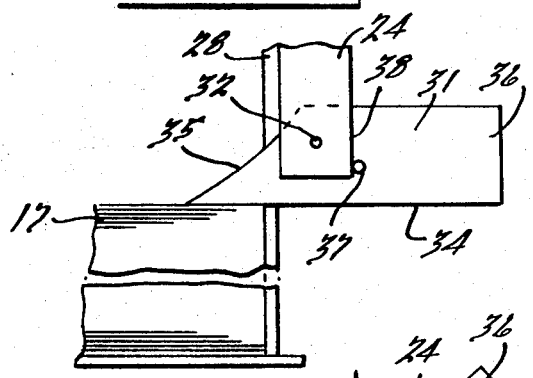
FIG. 6 is a view similar to FIG. 5, but showing how the pressure bar is swung back into pressure position after being lifted above the top of the stack.
Figure 5:
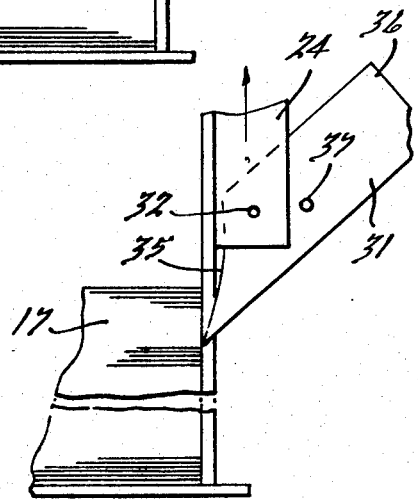
FIG. 5 is a fragmentary view in elevation showing how the pressure bar is swung into non-interfering relation with the stack when the weight is lifted.
Figure 4:
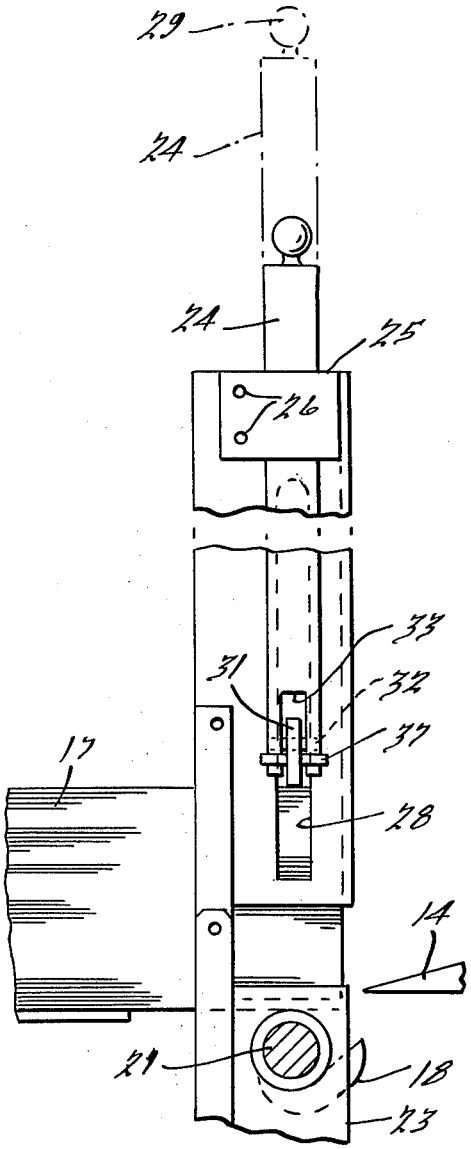
FIG. 4 is a rear elevational view taken in the direction of arrow 4 of FIG. 1.
Figure 3:
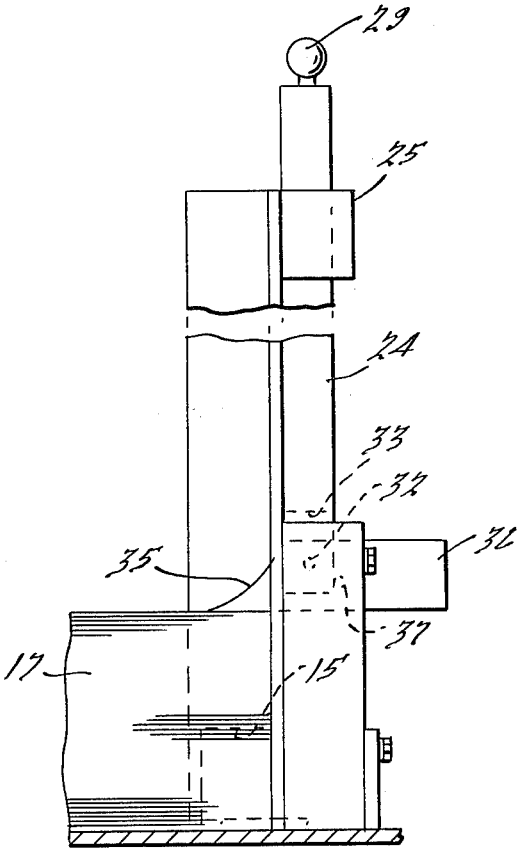
FIG. 3 is a side elevational view taken in the direction of the arrow 3 of FIG. 1.

A pressure bar 31 is pivotally mounted at 32 to the lower end of weight 24 within a slot 33. This slot is open toward the bottom of the weight and bar 31 extends therebelow, having a flat lower edge 34. The forward end 35 of bar 31 is inclined, with the lower end of this inclined edge being within the space occupied by stack portion 17, but the upper end being outside this space. A counterweighted portion 36 forms the rearward end of bar 31, and a stop pin 37 is carried by the bar and engageable with surface 38 of the slide as shown in FIG. 6. The arrangement is therefore such that when additional sheets are placed in the stack above portion 17 shown in FIG. 6, lifting of slide 24 will result in outward swinging of the bar as shown in FIG. 5, the bar being cammed counterclockwise by engagement of edge 35 with the side of the stack. As soon as the bar 31 has been lifted above the top of the stack, counterweighted portion 36 will cause it to swing clockwise into its FIG. 6 position. Release of knob 29 will then permit edge 24 to drop and, since this edge is horizontal, it will rest on the top of the stack and transmit the force of weight 24 to the entire corner of the stack.

In operation, bar 31 will always be in the position shown in FIG. 6 so that a constant and substantial weight is imparted to the corner of the stack, preventing any upward curling of the corner which might interfere with proper and effective functioning of finger 14 and depressor 18. When it is desired to add to the stack, which is ordinarily done from time to time during operation of the machine, no movement of the assembly need be made beforehand. The additional sheets will simply be placed on top of the existing stack and then knob 29 will be grasped and pulled upwardly. Weight 24, along with bar 31 will be elevated, the bar swinging counterclockwise as shown in FIG. 5. When the bar has cleared the new top of the stck, the knob will be released and the bar swung clockwise by the counterweight so that it may be dropped again on the stack.

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

I claim:

1. A device comprising, in combination, guide means for retaining a stack of sheets, a rotating slotted disk supporting said sheets, a finger and depressor at one corner of said sheets for periodically separating a sheet group at the bottom of the stack for entry into a disk slot, means for maintaining constant downward pressure on said corner of the stack comprising a vertically slidable weight mounted at said corner, a pressure bar movably mounted at the lower end of said weight and engageable with the top of said stack, and means for lifting said weight upwardly, said pressure bar being so shaped as to retract into non-interfering relation with sheets above it when said weight is lifted and move into stack-engaging position after said pressure bar has been lifted above the top of the stack, said pressure bar having a flat lower edge and an inclined inner edge facing said stack, whereby said bar will be cammed into non-interfering relation with the stack when the weight is lifted, said bar being counterweighted, and stop means on said bar and weight whereby the bar will be moved into stack-engaging position after being lifted above the top of the stack.

* * * * *